US005947275A

United States Patent [19]

Hess

[11] Patent Number: 5,947,275

[45] Date of Patent: Sep. 7, 1999

[54] PERSONAL DISINFECTION SYSTEM

[76] Inventor: Elizabeth R. Hess, 1911 E. LaRua St., Pensacola, Fla. 32501

[21] Appl. No.: 08/890,060

[22] Filed: Jul. 9, 1997

[51] Int. Cl.[6] ..... B65D 85/00

[52] U.S. Cl. ..... 206/210; 206/229; 206/484.2; 206/494

[58] Field of Search ..... 206/205, 209, 206/210, 213, 278, 440, 484, 484.2, 494, 229

[56] References Cited

U.S. PATENT DOCUMENTS

| | | | |
|---|---|---|---|
| D. 363,023 | 10/1995 | Taylor | D9/416 |
| 3,762,399 | 10/1973 | Riedell | 128/2 F |
| 3,923,577 | 12/1975 | Baab | 156/251 |
| 4,332,319 | 6/1982 | Hurwood | 206/210 |
| 4,347,931 | 9/1982 | Ginger et al. | 206/438 |
| 4,610,357 | 9/1986 | Nakamura | 206/449 |
| 4,843,652 | 7/1989 | Kuwahara | 2/167 |
| 4,951,815 | 8/1990 | Ulbrich | 206/213 |
| 4,954,239 | 9/1990 | Mueller | 206/213 X |
| 4,959,881 | 10/1990 | Murray | 15/227 |
| 5,065,863 | 11/1991 | Moyet-Ortiz | 206/210 |
| 5,111,934 | 5/1992 | Morin | 206/229 |
| 5,117,981 | 6/1992 | Crawford et al. | 206/570 |
| 5,301,806 | 4/1994 | Olson | 206/278 |
| 5,368,158 | 11/1994 | Miaud | 206/222 |
| 5,464,096 | 11/1995 | Hurwitz | 206/494 |
| 5,502,946 | 4/1996 | Storandt | 53/410 |
| 5,714,208 | 2/1998 | Ferrell et al. | 206/229 X |

*Primary Examiner*—Jacob K. Ackun
*Attorney, Agent, or Firm*—Peter Loffler

[57] ABSTRACT

A personal disinfection system is capable of providing a user ready access to a protective glove and to a towelette impregnated with a disinfectant or medicine for application to a desired surface. The personal disinfection system is comprised of a package having an upper and lower outer layer and a non-porous layer and a two-layer lamination layer therebetween. The towelette is sandwiched between the non-porous layer and the lamination layer. An outline of a glove is formed in the lamination layer and the upper layer of the lamination layer is laminated to the lower layer of the lamination layer along the outer periphery of the glove outline and an opening is formed in the base of the glove. The upper layer is peeled back exposing the lamination layer. A user's hand is inserted into the glove and the glove is detached from the remainder of the lamination layer. The towelette is retrieved and used as desired.

8 Claims, 3 Drawing Sheets

PERSONAL DISINFECTION SYSTEM

BACKGROUND OF THE INVENTION

1. Field of the Invention

The present invention relates to a system capable of shielding a person from a bacteria or virus.

2. Background of the Prior Art

Since the outbreak of AIDS, people have become much more cautious when physically interacting with one another. People are afraid to touch one another for fear of catching the deadly disease. Medical personal and others don various protective devices, such as face masks and gloves, when contacting a patient or a patient's bodily fluids. Police officers wear gloves when handling a subject who may have a cut somewhere on his person. Food workers are required to wear gloves when directly handling a food product. Most people will either refuse to sit on the seat of a public toilet or will do so only after placing a protective barrier thereon. These and other examples of people fearing contact with other people, directly or indirectly, are an outgrown of society's fear, real or otherwise, of the AIDS virus and other deadly viruses and bacteria that humans spread to one another. As the spread of the disease grows, so too will society's fear.

In some situations a person will want to disinfect a surface before coming in contact with the surface. An example of such a situation is the public toilet seat where no barrier is provided or a medical setting where some human fluid has been spilled. A person will want to disinfect the seat prior to sitting thereon. To accomplish this task, a towel impregnated with appropriate disinfectant is used to wipe down the desired surface. The towel is then cleaned or discarded. However, many people will fear that direct contact with the towel itself during the cleaning process will pose a risk. Whether such fear is realistic is immaterial, as it is a real fear in a person's mind.

Therefore, there is a need in the art for a system that allows a person to disinfect a desired surface without the possibility of the person directly contacting the surface. The device must be capable of ridding the surface of viruses and bacteria so that the surface is safe for human contact. The device should be capable of disinfecting a wide variety of surfaces while maintaining a prophylactic barrier between the hand performing the cleaning and the surface.

SUMMARY OF THE INVENTION

The personal disinfection system of the present invention addresses the aforementioned needs in the art. The personal disinfection system provides a package from which a user can retrieve a protective glove as well as a towelette to apply to a desired surface.

The personal disinfection system is comprised of a multi-layer package having upper and lower outer layers. A non-porous layer is positioned immediately above the lower outer layer while a two-layer lamination layer is positioned between the non-porous layer and the upper outer layer. A towelette is positioned between the non-porous layer and the lamination layer. An outline of a glove, thumbless or otherwise, is formed in the lamination layer and the upper layer of the lamination layer is laminated to the lower layer of the lamination layer along the outer periphery of the glove outline. An opening is created at the base of the glove. This forms a wearable glove within the lamination layer. Once a person inserts his hand into the glove, the glove is detached from the remainder of the lamination layer giving the user a protective glove upon his hand. Use of a thumbless glove allows the person to insert either hand into the glove. The user retrieves the towelette, which can be impregnated with a disinfectant or a medicant, and uses it as required.

The personal disinfection system gives a user a protective glove and a towelette within a single sealed package. The system is relatively small, allowing a person to carry it within a wallet, pursue or medical bag. Multiple packages can be connected to one another along a perforated connection line and these multiple packages can be positioned in a high use area, such as a medical facility or toilet, and can be placed into an appropriate dispenser. The system is easy to use and provides the person with the desired margin of safety when contacting a suspect surface. The system is of simple and straightforward design and construction.

BRIEF DESCRIPTION OF THE DRAWINGS

Similar reference numerals refer to similar parts throughout the several views of the drawings.

DESCRIPTION OF THE PREFERRED EMBODIMENT

Figure 2:
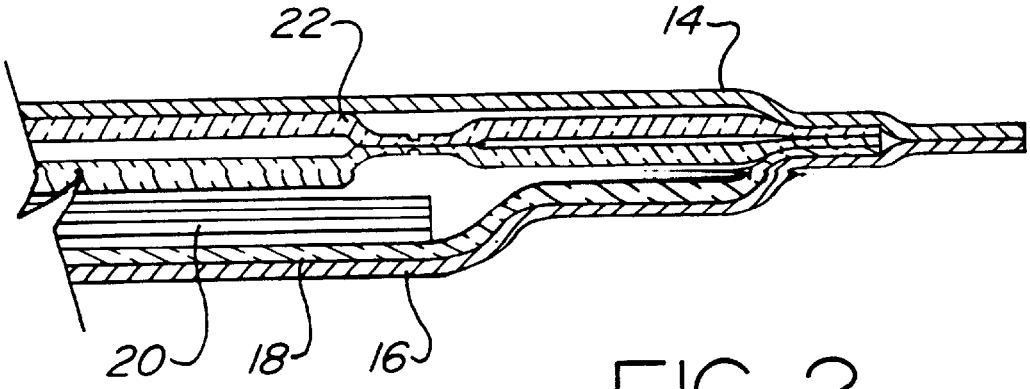
FIG. 2 is a cross-section view of the personal disinfection system.
Figure 3:
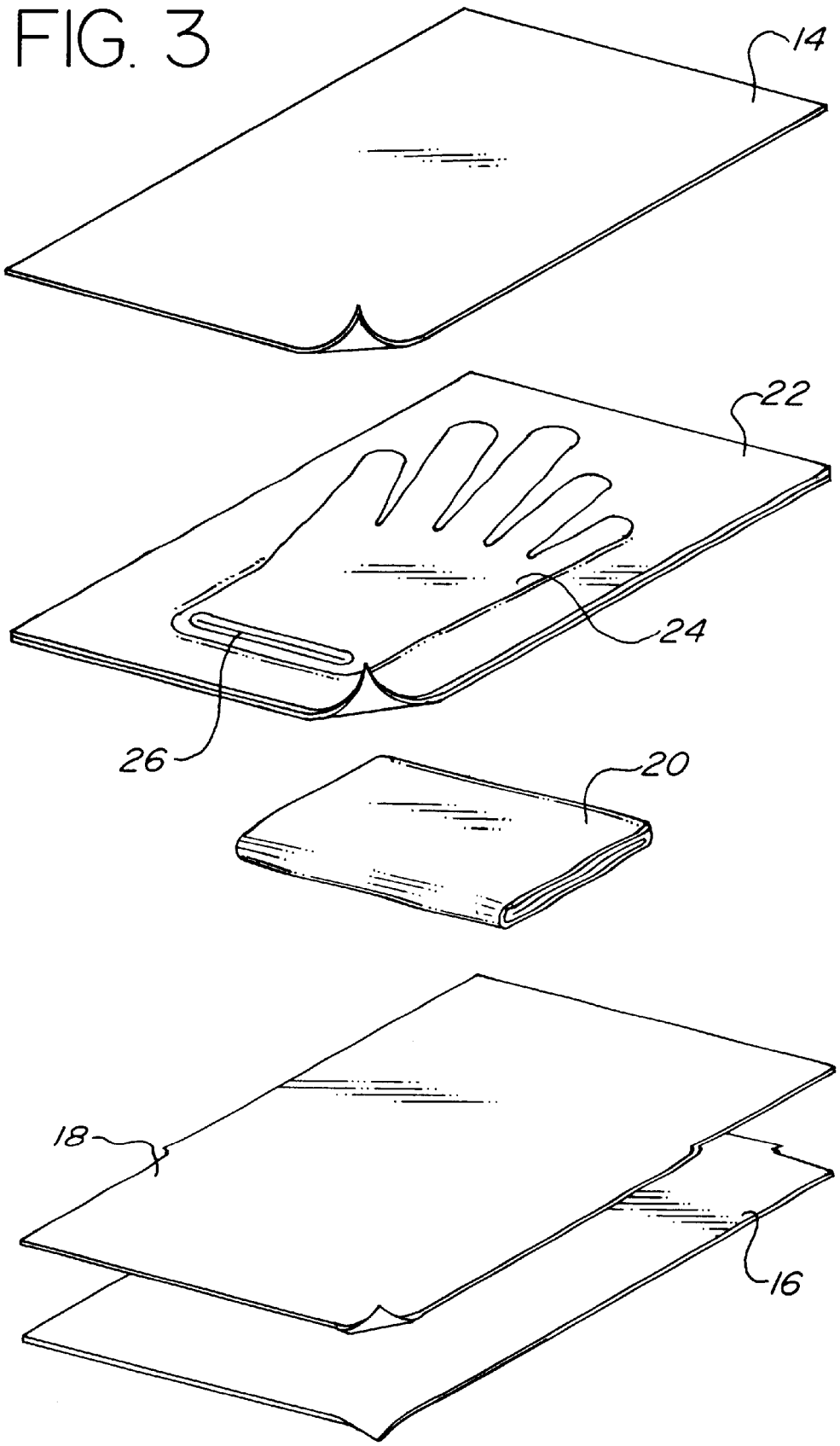
FIG. 3 is an exploded view of the personal disinfection system.

Referring now to the drawings, it is seen that the personal disinfection system of the present invention, generally denoted by reference numeral 10, is comprised of a multi-layer package 12. As seen in FIGS. 2 and 3, the package 12 is comprised of an upper outer layer 14 and a lower outer layer 16, with a non-porous layer 18, a towelette 20 and a two-layer lamination layer 22 therebetween. The upper outer layer 14 and the lower outer layer 16 can be made from any desired packing material such as paper, metal film, plastic and the like and may or may not be non-porous. If the upper layer 14 is not non-porous, then the lamination layer 22 creates the non-porous properties for the upper portion of the package 12. The non-porous layer 18 is made from any material having non-porous properties such as plastic, metal film, and the like. It is expressly recognized that the lower layer and the non-porous layer can be formed as a single layer. The towelette 20 is of the moist towelette type, known in the art, and is, advantageously, impregnated with a solution capable of killing most viruses and bacteria yet is relatively safe in contact with human skin. A bleach solution in water, in the solution range of less than one percent to greater than ninety percent of bleach to water by volume has been found to be satisfactory. The towelette 20 can also be impregnated with a fragrant. Alternately, the towelette 20 may be impregnated with a medicant, such as isopropyl alcohol, iodine, appropriate burn cream, or any other appropriate medicinal solution.

Figure 1:
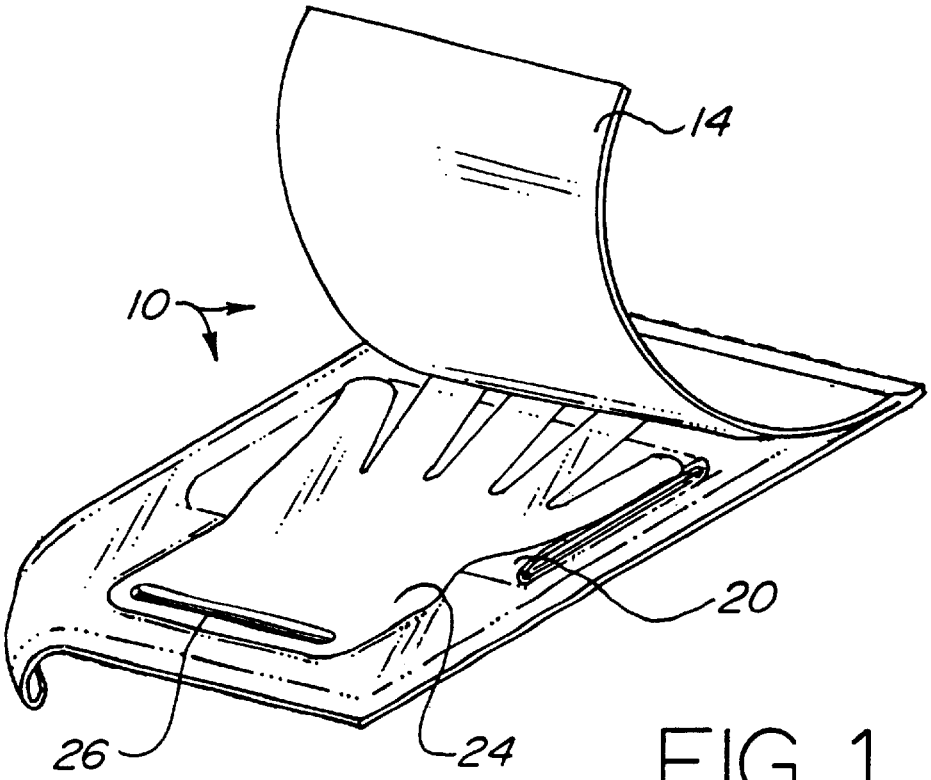
FIG. 1 is a perspective view of the personal disinfection system of the present invention with the upper outer layer partially peeled back.

As seen in FIGS. 1–3, the lamination layer 22 is a two-layer portion having a space therebetween. The lamination layer 22 is made from a flexible non-porous material that is appropriate for a protective glove, such as rubber or latex. As seen in FIG. 1, an outline of a glove 24 is formed in the lamination layer 22 with the upper ply of the lamination layer 22 being laminated to the lower ply of the lamination layer 22 along the outer periphery of the glove 24. An opening 26 is maintained at the base of the glove 24. As seen, the glove 24 may be ambidextrous.

The various layers are all stacked onto one another with the outer peripheries of the various layers, except the towelette 20, being sealed in order to provide an airtight environment within the package 12. This maintains the sterility of the interior of the package 12 and prevents the towelette 20 from drying out.

In order to use the personal disinfection system 10, the upper layer 14 is peeled back, exposing the lamination layer 22. A person inserts his hand into the opening 26 at the base of the glove 24 and fits his hand into the glove 24. Once the hand is firmly within the glove 24, the person lifts up on the glove 24 separating the glove 24 from the remainder of the lamination layer 22. Although the lamination of the outer periphery of the glove 24 should cause sufficient weakening of the connection between the glove 24 and the remainder of the lamination layer 22 to provide easy separation of the two, if desired, the connection can be scored or otherwise perforated during manufacture (without compromising the airtight properties of the package 12) in order to assure a relatively easy separation of glove 24 from lamination layer 22. Once the glove 24 is appropriately separated, the person has the glove 24 on his hand. The towelette 20 is then retrieved from the package 12 and the desired surface is rubbed with the towelette 20. As the person is wearing the glove 24, the person's hand need never directly touch the surface being wiped. Once the cleaning is finished, the package 12 and the towelette 20 are both appropriately discarded and thereafter the glove 24 is removed and it is also appropriately discarded.

Figure 4:
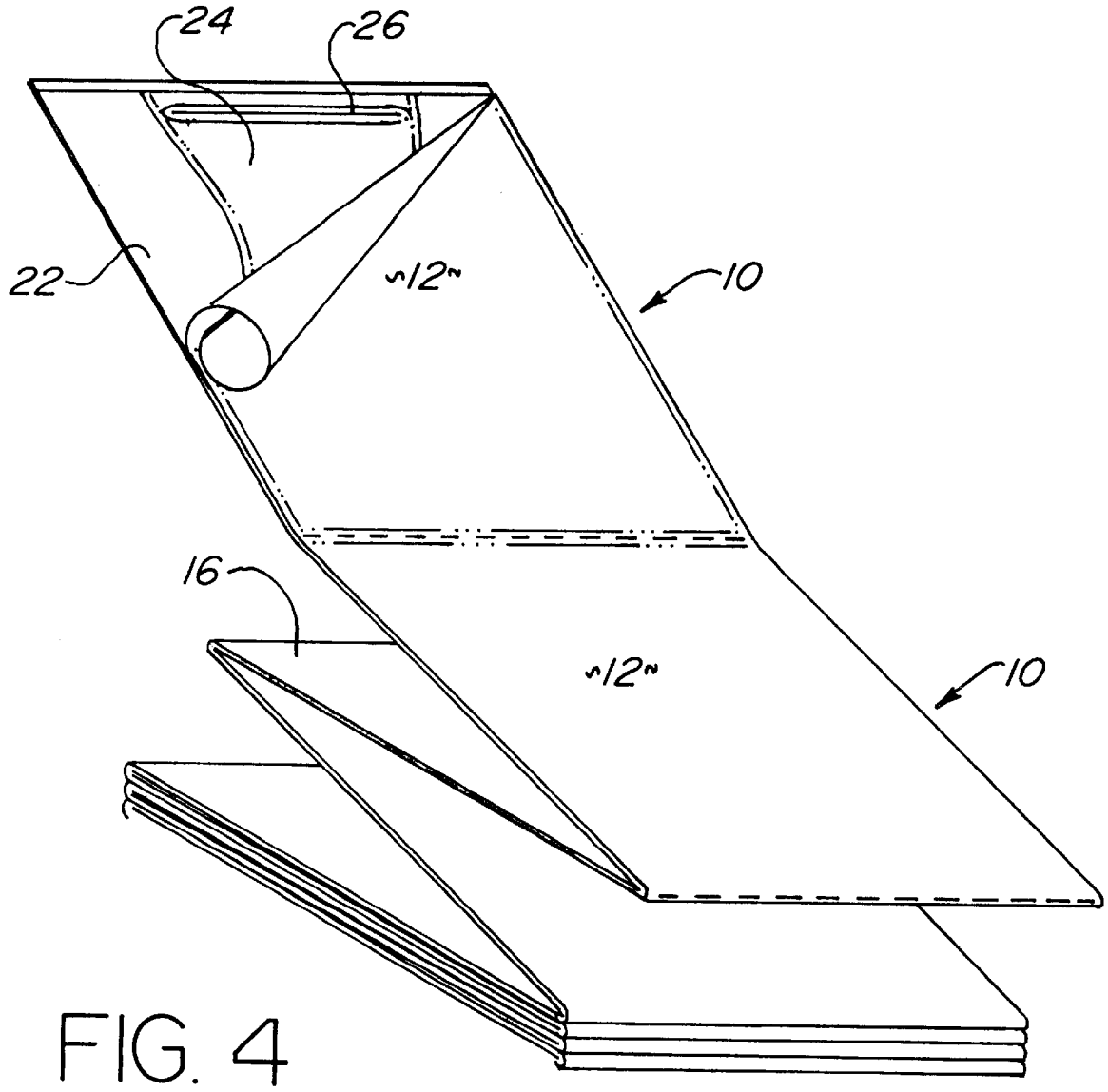
FIG. 4 is a perspective view of several packages joined to one another.

The package 12 is sufficiently small so that it can be carried in a purse or medical kit bag. As seen in FIG. 4, several packages 12 can be connected to each other at their ends along a perforated connection. This permits a series of packages 12 to be stored in a desired location such as a medical facility or a public toilet, and possibly within a desired dispenser, in order to provide a ready supply of the system 10 upon demand.

While the invention has been particularly shown and described with reference to an embodiment thereof, it will be appreciated by those skilled in the art that various changes in form and detail may be made without departing from the spirit and scope of the invention.

I claim:

1. A personal disinfection system comprising:

a glove;

a towelette impregnated with an element;

a upper layer having a first outer periphery;

a two-ply lamination layer having a second outer periphery and a pair of interior faces such that the glove is attached within the pair of interior faces;

a non-porous layer having a third outer periphery; and a lower layer having a fourth outer periphery such that the first outer periphery, the second outer periphery, the third outer periphery and the fourth outer periphery are attached.

2. The personal disinfection system as in claim 1 wherein the first package means comprises:

a upper layer having a first outer periphery;

a two-ply lamination layer having a second outer periphery and a pair of interior faces such that the glove is attached within the pair of interior faces;

a non-porous layer having a third outer periphery; and a lower layer having a fourth outer periphery such that the first outer periphery, the second outer periphery, the third outer periphery and the fourth outer periphery are attached.

3. The personal disinfection system as in claim 1 further comprising at least one second package means attached to the first package means.

4. The personal disinfection system as in claim 1 wherein the element is chosen from the group consisting of a disinfectant, a medicant, or a fragrant.

5. A personal disinfection system comprising:

a upper layer having a first outer periphery;

a first lamination layer having a second outer periphery and a first interior face;

a second lamination layer having a third outer periphery and a second interior face;

an attachment line, in the shape of a glove having at least one finger receiving portion and a base having an opening, attaching the first interior face with the second interior face;

a non-porous layer having a fourth outer periphery such that the first outer periphery, the second outer periphery, the third outer periphery and the fourth outer periphery are attached;

a towelette impregnated with an element, disposed between the second lamination layer and the non-porous layer; and a lower layer having a fifth outer periphery attached to the fourth outer periphery.

6. The personal disinfection system as in claim 5 wherein the glove is ambidextrous.

7. The personal disinfection system as in claim 5 wherein the attachment line is scored.

8. The personal disinfection system as in claim 5 wherein the element is chosen from the group consisting of a disinfectant, a medicant, or a fragrant.

* * * * *